US009759073B1

(12) United States Patent
Martin, Jr. et al.

(10) Patent No.: US 9,759,073 B1
(45) Date of Patent: Sep. 12, 2017

(54) TURBINE AIRFOIL HAVING NEAR-WALL COOLING INSERT

(71) Applicant: Siemens Energy Inc., Orlando, FL (US)

(72) Inventors: Nicholas F. Martin, Jr., York, SC (US); David J. Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 15/055,003

(22) Filed: Feb. 26, 2016

(51) Int. Cl.
*F01D 5/18* (2006.01)
*F01D 9/02* (2006.01)
*F01D 25/12* (2006.01)

(52) U.S. Cl.
CPC ..... *F01D 5/188* (2013.01); *F01D 9/02* (2013.01); *F01D 25/12* (2013.01); *F05D 2220/32* (2013.01); *F05D 2230/80* (2013.01); *F05D 2250/183* (2013.01); *F05D 2260/20* (2013.01); *F05D 2300/10* (2013.01); *F05D 2300/20* (2013.01)

(58) Field of Classification Search
CPC ..... F01D 5/188; F01D 5/189; F01D 5/284
See application file for complete search history.

(56) References Cited

U.S. PATENT DOCUMENTS 3,902,820 A * 9/1975 Amos ..... F01D 5/189 416/191
7,497,655 B1 3/2009 Liang
7,828,515 B1 * 11/2010 Kimmel ..... F01D 5/189 415/115
8,167,537 B1 * 5/2012 Plank ..... F01D 5/147 415/115
8,556,578 B1 * 10/2013 Memmen ..... F01D 5/189 277/644
8,608,430 B1 12/2013 Liang
8,864,438 B1 * 10/2014 Lee ..... F01D 5/188 415/1
2014/0105726 A1 4/2014 Lee

* cited by examiner

*Primary Examiner* — Justin Seabe

(57) ABSTRACT

A turbine airfoil is provided with at least one insert positioned in a cavity in an airfoil interior. The insert extends along a span-wise extent of the turbine airfoil and includes first and second opposite faces. A first near-wall cooling channel is defined between the first face and a pressure sidewall of an airfoil outer wall. A second near-wall cooling channel is defined between the second face and a suction sidewall of the airfoil outer wall. The insert is configured to occupy an inactive volume in the airfoil interior so as to displace a coolant flow in the cavity toward the first and second near-wall cooling channels. A locating feature engages the insert with the outer wall for supporting the insert in position. The locating feature is configured to control flow of the coolant through the first or second near-wall cooling channel.

10 Claims, 6 Drawing Sheets

View III-III

View III-III

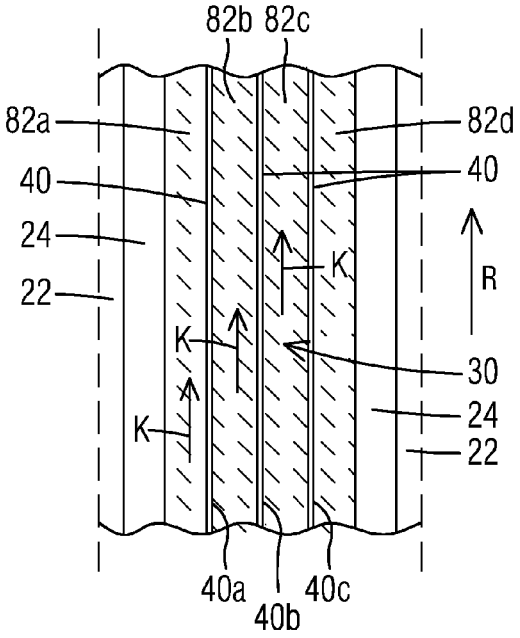
FIG 4A
View IV-IV
FIG 4B
View IV-IV
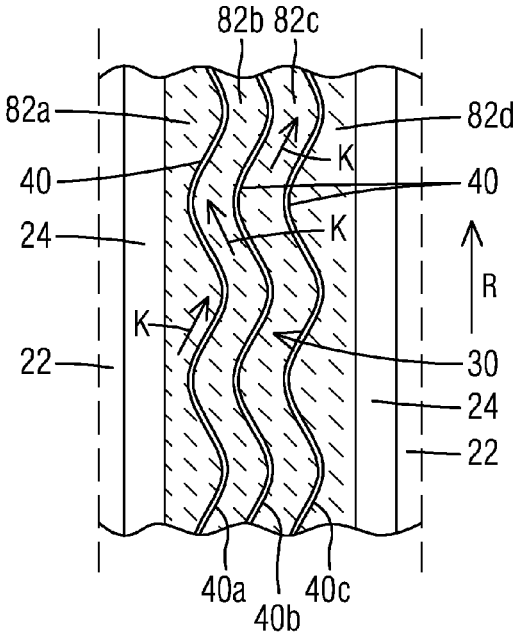
FIG 4C
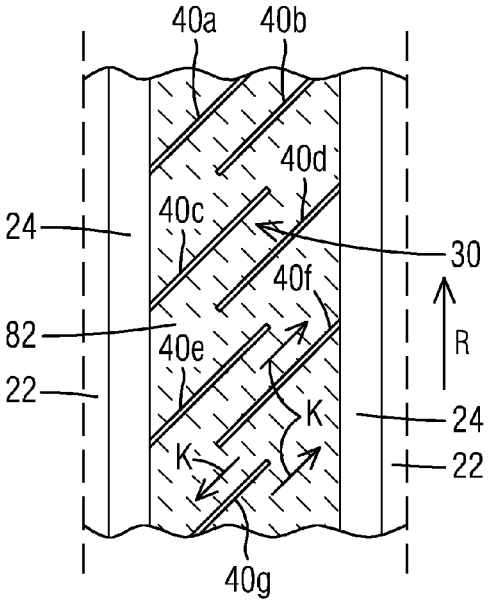

View VII-VII

View IX-IX

TURBINE AIRFOIL HAVING NEAR-WALL COOLING INSERT

STATEMENT REGARDING FEDERALLY SPONSORED DEVELOPMENT

Development for this invention was supported in part by Contract No. DE-FE0023955, awarded by the United States Department of Energy. Accordingly, the United States Government may have certain rights in this invention.

BACKGROUND

1. Field

The present invention relates to turbine airfoils for gas turbine engines, and in particular to a turbine airfoil having one or more inserts for near-wall cooling.

2. Description of the Related Art

In a turbomachine, such as an axial flow gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., blades, where the turbine blades extract energy from the hot combustion gases for powering the compressor section and providing output power. Since the airfoils, i.e., vanes and blades, are directly exposed to the hot combustion gases, they are typically provided with an internal cooling passage that conducts a coolant, such as compressor bleed air, through the airfoil.

One type of turbine airfoil includes a radially extending outer wall made up of opposite pressure and suction sidewalls extending from leading to trailing edges of the airfoil. The cooling channel extends inside the airfoil between the pressure and suction sidewalls and conducts the cooling fluid in alternating radial directions through the airfoil.

In a turbine airfoil, achieving a high cooling efficiency based on the rate of heat transfer is a significant design consideration in order to minimize the volume of coolant air diverted from the compressor for cooling.

SUMMARY

Briefly, aspects of the present invention provide a turbine airfoil having a near wall cooling insert.

According to a first aspect of the invention, a turbine airfoil is provided. The turbine airfoil comprises an outer wall delimiting an airfoil interior. The airfoil interior comprises internal cooling channels. The outer wall extends span-wise in a radial direction of a turbine engine and is formed of a pressure sidewall and a suction sidewall joined at a leading edge and at a trailing edge. At least one insert is positioned in a cavity in the airfoil interior. The insert extends along a radial extent of the turbine airfoil and comprises first and second opposite faces, whereby a first near-wall cooling channel is defined between the first face and the pressure sidewall and a second near-wall cooling channel is defined between the second face and the suction sidewall. The insert is configured to occupy an inactive volume in the airfoil interior so as to displace a radial coolant flow in the cavity toward the first and second near-wall cooling channels. A locating feature is provided that engages the insert with the outer wall to support the insert in position. The locating feature is configured to control flow of the coolant through the first or second near-wall cooling channel.

According to a second aspect of the invention, a retrofit kit for a turbine airfoil is provided. The retrofit kit includes an insert sized to be positioned in a cavity in an airfoil interior such that the insert extends along a span of the turbine airfoil. The insert comprises first and second opposite faces and is configured such that when positioned in the airfoil interior: the first face is spaced from a pressure sidewall of an airfoil outer wall to define a first near-wall cooling channel between the first face and the pressure sidewall; the second face is spaced from a suction sidewall of the airfoil outer wall to define a second near-wall cooling channel between the second face and the suction sidewall; and the insert occupies an inactive volume in the airfoil interior so as to displace a coolant flow in the cavity toward the first and second near-wall cooling channels. The retrofit kit further comprises at least one locating feature configured for engaging the insert with the airfoil outer wall to support the insert in position. The locating feature is configured to control flow of the coolant through the first or second near-wall cooling channel.

According to a third aspect of the invention, a method for retrofitting a turbine airfoil is provided. The method comprises introducing an insert into a cavity in an airfoil interior such that the insert extends along a span of the turbine airfoil. The insert comprises first and second opposite faces and is configured such that when introduced in the airfoil interior: the first face is spaced from a pressure sidewall of an airfoil outer wall to define a first near-wall cooling channel between the first face and the pressure sidewall; the second face is spaced from a suction sidewall of the airfoil outer wall to define a second near-wall cooling channel between the second face and the suction sidewall; and the insert occupies an inactive volume in the airfoil interior so as to displace a coolant flow in the cavity toward the first and second near-wall cooling channels. The method further comprises supporting the insert in position via at least one locating feature that engages the insert with the airfoil outer wall. The locating feature is configured to control flow of the coolant through the first or second near-wall cooling channel.

BRIEF DESCRIPTION OF THE DRAWINGS

The invention is shown in more detail by help of figures. The figures show specific configurations and do not limit the scope of the invention.

FIGS. 4A and 4B and 4C are schematic span-wise cross-sectional views through a turbine airfoil showing exemplary span-wise configurations of the locating feature;

DETAILED DESCRIPTION

Figure 1:
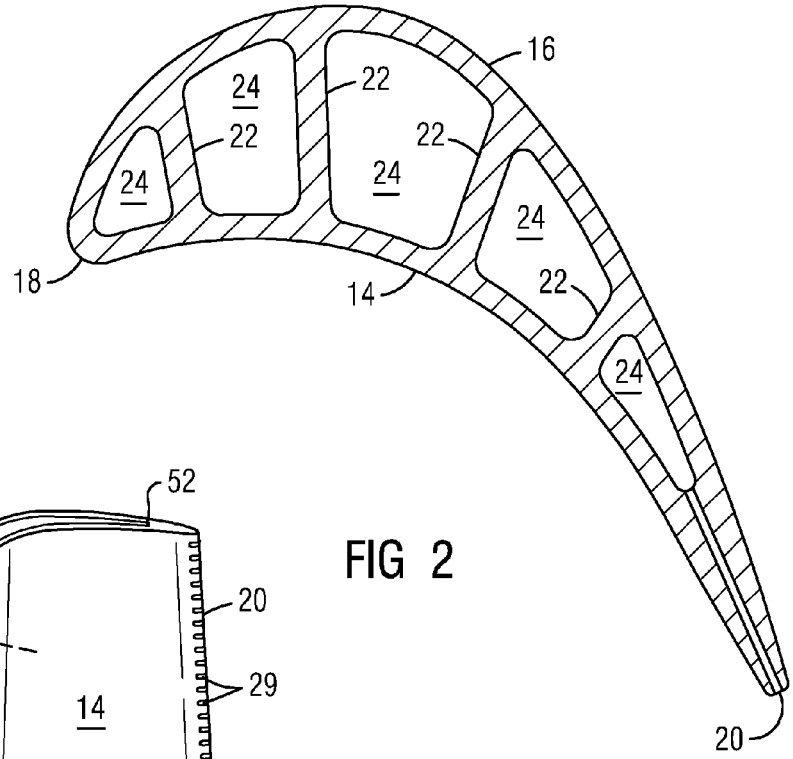
FIG. 1 is a schematic cross-sectional view through a two-wall airfoil with radial internal cooling channels.

In the following detailed description, across different embodiments, like reference characters have been used to designate like or corresponding elements for the sake of simplicity.

In this description, various specific details are set forth in order to provide a thorough understanding of such embodiments. However, those skilled in the art will understand that disclosed embodiments may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Also, unless otherwise specified, the connector "or", as used herein, implies an inclusive "or", which is to say that the phrase "A or B" implies: A; or B; or both A and B. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

As shown in FIG. 1, a typical turbine blade or vane may involve a two-wall structure including a pressure sidewall 14 and a suction sidewall 16 joined at a leading edge 18 and at a trailing edge 20. Internal cooling cavities 24 may be created by employing partition walls or ribs 22 which connect the pressure and suction sidewalls 14 and 16. The internal cooling cavities 24 may, for example, conduct coolant in alternating radial directions to form one or more serpentine cooling paths, which may be forward and/or aft flowing. In such a cooling scheme, the coolant fills the entire cavity 24, which may result in a greater coolant requirement than is actually needed to cool the component, because it is generally favorable to maintain a minimum coolant flow momentum in order to keep the flow moving in the desired direction.

The present inventors have noted that a more efficient use of coolant would be possible if the coolant flow could be largely confined to the area very close to the hot outer wall, i.e., the pressure and suction sidewalls 14 and 16. This effect may be referred to as near-wall cooling. The present disclosure provides a technique for confining the radial coolant flow to the near-wall region without filling the entire cavity 24 with coolant, thereby reducing the coolant flow rate and increasing gas turbine efficiency. According to the embodiments of the present invention illustrated in FIGS. 2-9, the above is achieved by providing an insert 30 in one or more of the cooling cavities 24. The insert 30 occupies an inactive volume inside the cavity 24, which is to say that there is no coolant flow through the volume occupied by the insert 30. The insert 30 thus functions to displace the radially flowing coolant from the central portion of the airfoil 10 toward the hot pressure and suction sidewalls 14 and 16, while also increasing the target wall velocities as a result of the narrowing of the flow cross-section. The insert 30 provides near-wall cooling without the thermal fight between the hot-outer walls and cooler inner walls of the airfoil when all the walls are integrally cast structures. The insert 30 may be supported in position via one or more locating features 40 that engage the insert 30 with the outer wall 12, providing flexibility to the airfoil to survive the thermal-mechanical loads experienced during engine operation.

Figure 2:
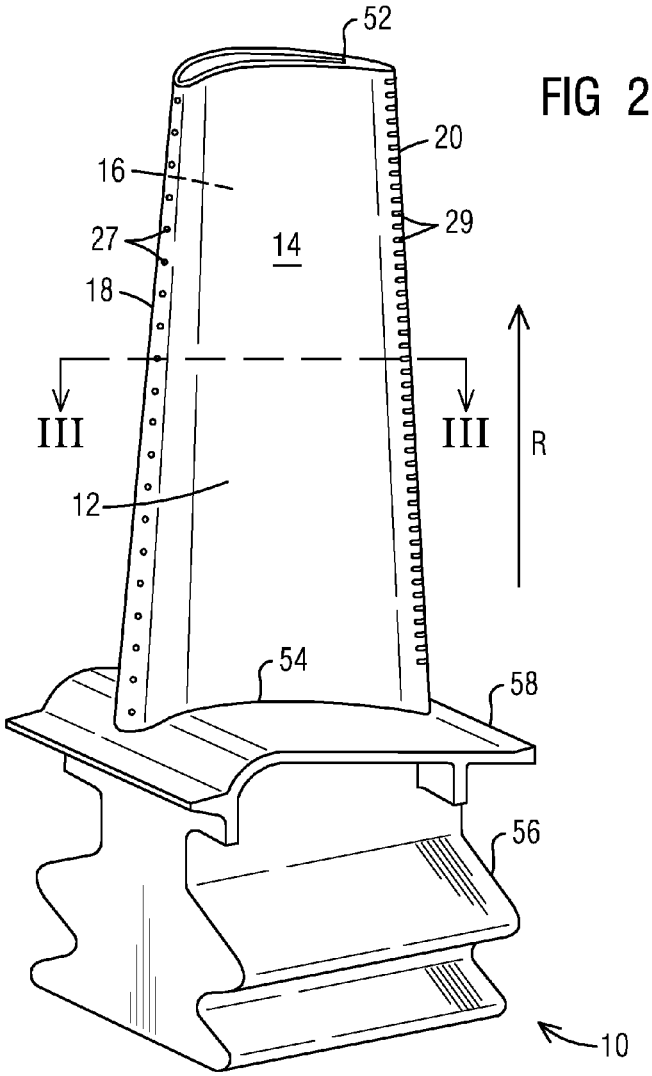
FIG. 2 is a perspective view of an example turbine airfoil in which embodiments of the present invention may be incorporated.

Referring now to FIG. 2, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The airfoil 10 comprises an outer wall 12 adapted for use, for example, in a high pressure stage of an axial flow gas turbine engine. The outer wall 12 extends span-wise along a radial direction R of the turbine engine, and is formed of a generally concave pressure sidewall 14 and a generally convex suction sidewall 16 joined at a leading edge 18 and at a trailing edge 20. The outer wall 12 delimits a hollow airfoil interior which may comprise one or more internal cooling channels (not shown in FIG. 2) that extend along a radial extent of the airfoil 10. As illustrated, the outer wall 12 may be coupled to a root 56 at a platform 58. The root 56 may couple the turbine airfoil 10 to a disc (not shown) of the turbine engine. The outer wall 12 is delimited in the radial direction by a radially outer end face or airfoil tip 52 and a radially inner end face 54 coupled to the platform 58. In an alternate embodiment, in case of a stationary vane, the radially inner end face of the airfoil 10 may be coupled to the inner diameter of the turbine section of the turbine engine and the radially outer end face of the turbine airfoil 10 may be coupled to the outer diameter of the turbine section of the turbine engine. In the illustrated example, the internal cooling channels of the airfoil 10 may receive a coolant, such as air from a compressor section (not shown), via one or more coolant supply passages (not shown) through the root 56. The coolant traverses through the internal cooling channels, and exits the airfoil 10 via exhaust orifices 27 and 29 positioned along the leading edge 18 and the trailing edge 20 respectively. Although not shown in the drawings, exhaust orifices may be provided at multiple other locations, including anywhere on the pressure sidewall 14, and/or suction sidewall 16, and/or the airfoil tip 52. In one embodiment, the airfoil 10, including the outer wall 12, the root 56 and the platform 58 is integrally formed by casting, for example from a ceramic casting core. However, other manufacturing techniques may be used, including, for example, additive manufacturing processes such as 3-D printing.

Figure 3:
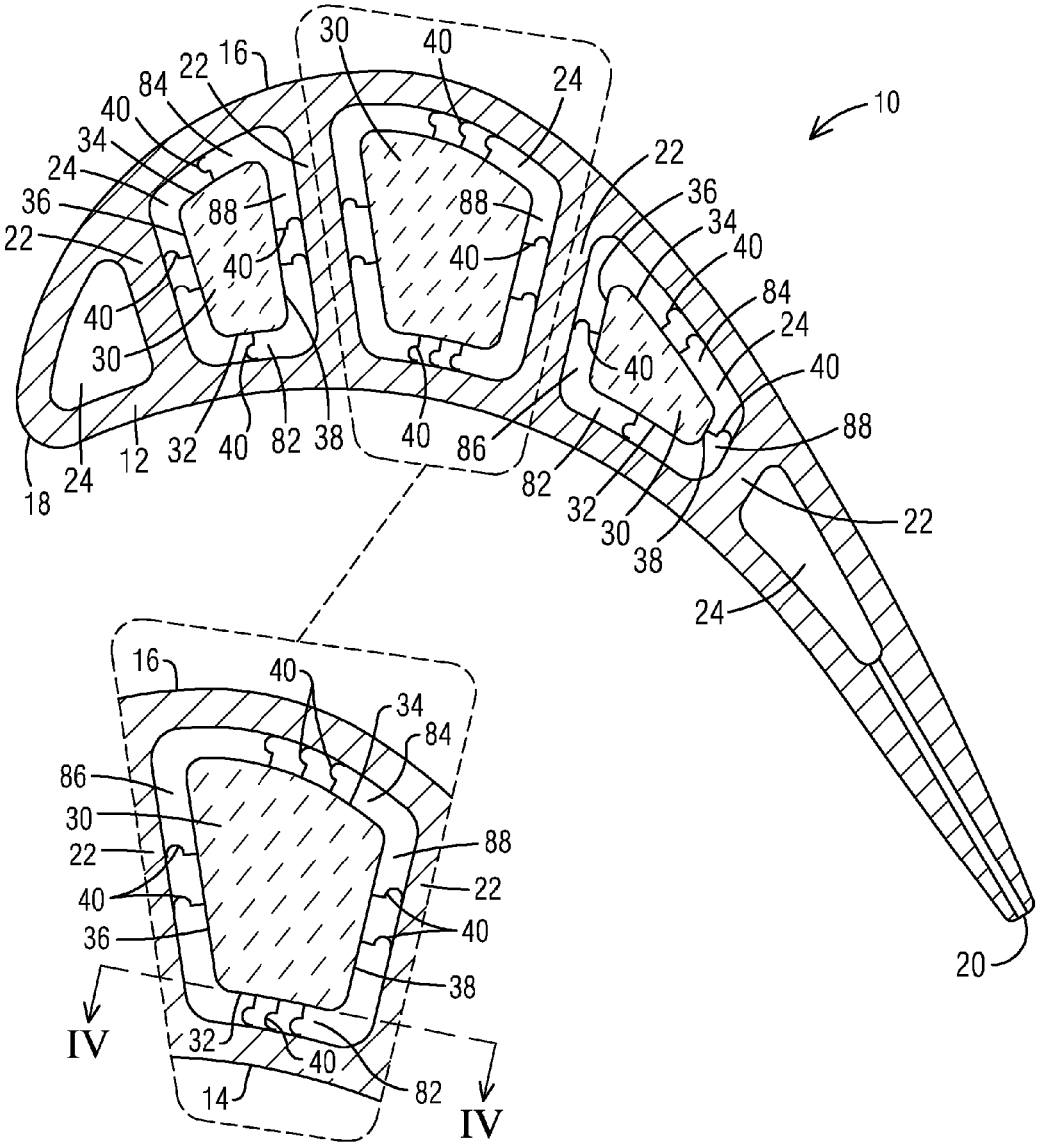
FIG. 3 is a schematic cross-sectional view through a turbine airfoil illustrating a near-wall cooling insert according a first exemplary embodiment.

FIG. 3 is a cross-sectional view through the airfoil 10 illustrating a first embodiment incorporating aspects of the present invention. As shown, the airfoil 10 comprises multiple radially extending partition ribs 22, formed integrally with the airfoil outer wall 12. The ribs 22 connect the pressure and suction sidewalls 14 and 16, whereby radial cavities 24 are defined between adjacent partition ribs 22. As per the embodiment, the airfoil 10 is provided with one or more inserts 30 (in this case, three inserts 30), which are formed separately from the outer wall 12 and inserted into a respective radial cavity 24. The insert 30 fills up the respective cavity 24 volume to a large extent and limits the coolant flow to the near-wall region adjacent to the pressure and suction sidewalls 14 and 16. As shown, each insert 30 has at least a first face 32 and a second face 34. The first face 32 is spaced from the pressure sidewall 14 to define a first near-wall cooling channel 82, while the second face 34 is spaced from the suction sidewall 16 to define a second near-wall cooling channel 84. In this embodiment, each insert 30 also comprises third and fourth faces 36, 38 extending between the first and second faces 32, 34. The third and fourth faces 36, 38 are respectively spaced from the adjacent partition ribs 22 on either side to form first and second connecting channels 86 and 88. The insert 30 is configured so as to occupy an inactive volume in the respective cavity 24. That is to say that there is no coolant flow through the volume occupied by the insert 30, with flow only taking place radially along the near-wall cooling channels 82, 84 and along the connecting channels 86, 88. The size of the near-wall cooling channels 82, 84 as well as the connecting channels 86, 88 may be defined, for example, by cooling requirements for the coolant flow rate and coolant supply pressure. The insert 30 thus serves to displace the radially flowing coolant to the regions that need the most cooling, i.e. the near-wall region adjacent to the outer wall, while at the same time reducing the radial flow cross-section, whereby a lesser coolant is required to maintain flow momentum and to cool the component.

In the illustrated embodiment, each insert 30 is configured as a solid body with four sides. However, instead of a solid construction, one or more inserts 30 may have a hollow construction defining a central cavity through the insert 30. In such a case, the radial ends of the insert cavity may be capped or sealed off to prevent ingestion of coolant into the insert cavity. A hollow construction of the insert 30 may provide reduced thermal stresses as well as lighter centrifugal loads in case of rotating airfoils. Furthermore, the illustrated cross-sectional shape of the insert 30 is merely exemplary and other cross-sectional shapes may be employed, for example, depending on the shape of the cavity. Such shapes include but are not limited to triangular, oval, elliptical, circular, or even a plate-shaped insert essentially consisting of first and second sides facing the pressure and suction sidewalls. A plate-shaped insert may be used, for example in case of narrow airfoils and/or in cavities closer to the trailing edge.

In order to properly locate the insert 30 in the cavity 24, one or more locating features 40 may be provided that engage the insert 30 with the outer wall 12 for supporting the insert 30 in position. Further to the structural aspect, the locating features 40 may additionally be formed as part of an inventive flow control in the near-wall cooling channels 82, 84. The locating features 40 may be configured to be flexible, allowing the insert 30 and the outer wall 12 to move separately from each other, for example, on account of differences in thermal and/or mechanical loads. The flexible locating feature 40 permits the use of an insert material having a significantly different coefficient of thermal expansion than that of the airfoil outer wall 12.

The material selection of the insert may be based on thermal and/or mechanical loads during engine operation. In one embodiment, the insert may be made of a ceramic material, particularly a ceramic matrix composite (CMC) which provides a significantly lower coefficient of thermal expansion than the metallic airfoil outer wall 12. To provide a suitable spring force, the flexible locating features 40 may be preferably formed of a metal. The flexible locating features 40 may be formed integrally with the insert 30 or may be separately formed and engaged with the insert 30 and the outer wall 12 during installation of the insert 30 in the cavity 24. In one embodiment, the metal of the locating features 40 may be embedded with the ceramic material of the insert 30 during a molding process whereby the locating feature 40 is monolithically formed with the insert 30. In one embodiment, the flexible locating features 40 may be designed as stiffeners to structurally reinforce a CMC insert. In other embodiments, the insert 30 may be formed of a metal. The insert may be further be formed in one-piece, i.e., monolithically, or may be formed as multiple span-wise pieces that may be stacked radially during installation of the insert. Multi-piece inserts may be used for complicated geometries resulting from advanced aerodynamic designs, including for example 3-D airfoils in which the cross-sectional shape of the airfoil varies from the root to the tip. The stack of insert pieces would fill the cavity in the same manner as a one-piece insert, but would be able to conform to the complicated cavity shape. In some embodiments, only one insert may be provided, typically in the cavity next to the leading edge cavity. This may be applicable for complex blade geometries where the shape or chord-length of the other cavities (located aft of the insert) may vary from the root to the tip of the airfoil.

In the illustrated embodiment, each locating feature 40 is configured as a compressed spring that maintains pressurized contact with the insert 30 and outer wall 12 even under relative movement between the insert 30 and the outer wall 12. The spring action functions to fixture the insert 30 in the plane orthogonal to the span-wise direction (i.e., in the plane of FIG. 3). Once inserted into the airfoil 10, a locking cap or plate may be used to locate the insert 30 in the span-wise direction. The flexible locating features 40 may take any shape to provide the locating spring rate support as well as be part of the coolant flow control.

FIGS. 4A-C illustrate exemplary span-wise configurations of the locating features 40. Referring to FIG. 4A, in one embodiment, the locating features 40 are configured as multiple flexible supports 40*a*, 40*b*, 40*c* that extend continuously along a radial extent of the insert 30. In this embodiment, the supports 40*a*, 40*b*, 40*c* extend radially along a straight profile. The supports 40*a*, 40*b*, 40*c* further extend all the way from the insert 30 to the outer wall 12 (in this case the pressure side wall 14), so as to divide the near-wall cooling channel 82 into multiple discrete radial flow passes 82*a*, 82*b*, 82*c*, 82*d*. In this illustration, the radial flow passes 82*a*, 82*b*, 82*c*, 82*d* are each shown to conduct coolant K in a radially outward direction. In alternate embodiments, one or more of the radial flow passes 82*a*, 82*b*, 82*c*, 82*d* may conduct coolant K in a radially inward direction. In yet another embodiment, adjacent radial flow passes may conduct coolant in alternating radial directions to form a serpentine cooling path in the near-wall cooling channel 82. In this case, the flow passes 82*a*, 82*b*, 82*c*, 82*d* may be interconnected at radial ends of one or more of the locating features 40 (i.e., supports 40*a*, 40*b*, 40*c*). The serpentine scheme may be configured a function of the radial length and/or position of each of the locating features 40. In an alternate embodiment as illustrated in FIG. 4B, one or more of the continuous flexible supports 40*a*, 40*b*, 40*c* may be curved, for example having a periodic or wavy profile along the radial direction R. The curvature of the supports 40*a*, 40*b*, 40*c* results in a longer radial flow path of the coolant K in the flow passes 82*a*, 82*b*, 82*c*, 82*d*, thereby increasing the surface area for convective heat transfer between the coolant K and the outer wall 12. As in the previous embodiment, the flow passes 82*a*, 82*b*, 82*c*, 82*d* may be interconnected at radial ends of one or more of the curved supports 40*a*, 40*b*, 40*c*, such that adjacent radial flow passes conduct coolant in alternating radial directions to form a serpentine cooling path in the near-wall cooling channel 82. In yet another embodiment illustrated in FIG. 4C, the locating feature 40 comprises multiple discontinuous flexible supports 40*a-f*, each oriented at an angle with respect to the radial direction R. As shown, the supports 40*a-f* are arranged in distinct radial rows with the supports 40*a*, 40*c*, 40*e* forming a first radial row and the supports 40*b*, 40*d*, 40*f* forming a second radial row. As illustrated, the supports in the first and second rows are staggered in the radial direction and overlap in the axial direction. In this case, the resultant flow path of the coolant K has a serpentine or zigzagged profile extending in the radial direction R. Referring back to FIG. 3, for each of the above-described embodiments, the flow control features in one near-wall cooling channel 82 (or 84) may be co-operatively combined with similar or different types of flow control features in successive near-wall cooling channels 82 (or 84) formed by successive inserts 30.

Figure 5:
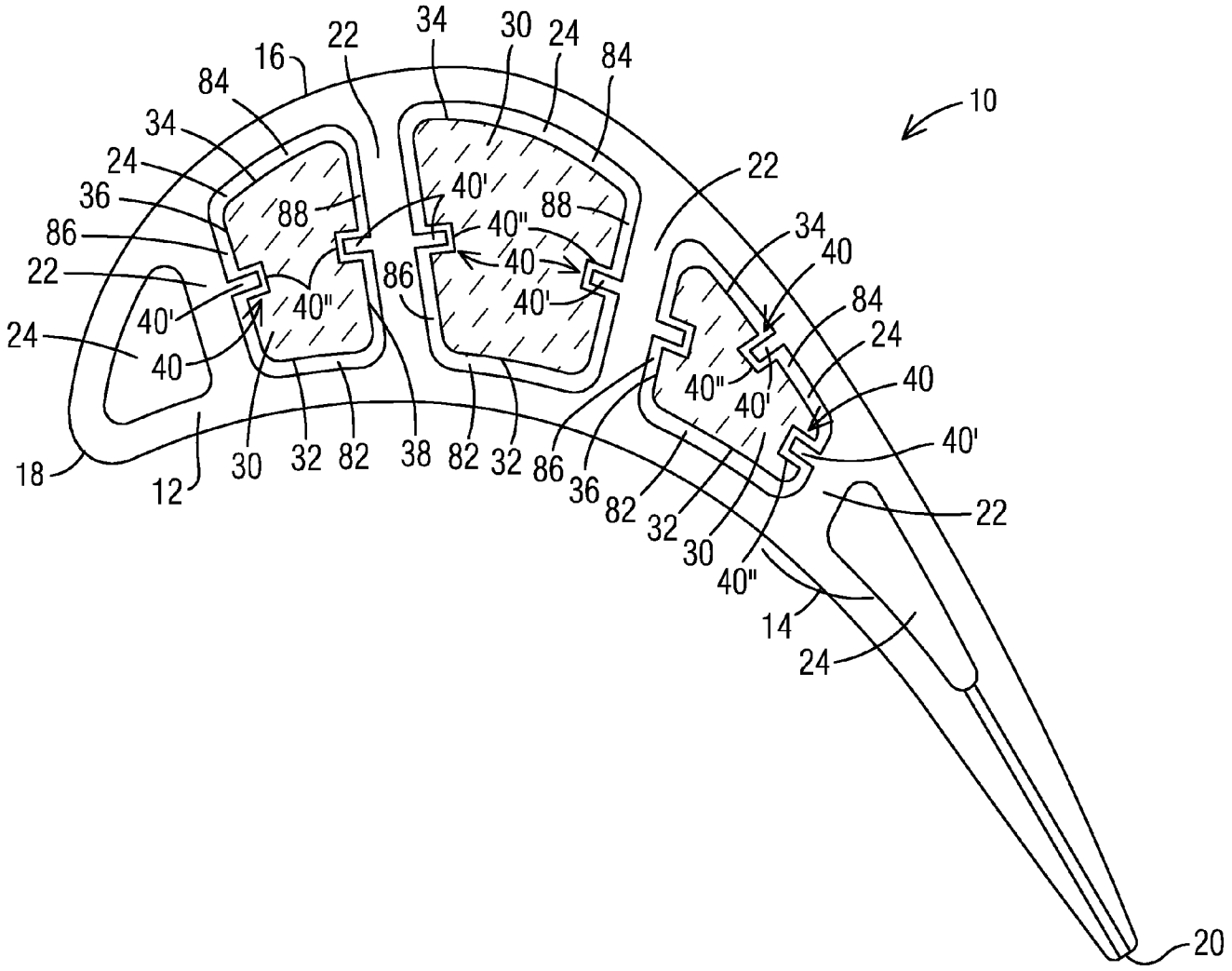
FIG. 5 is a schematic cross-sectional view through a turbine airfoil illustrating a near-wall cooling insert according a second exemplary embodiment.

FIG. 5 is a cross-sectional view through an airfoil 10 illustrating a second embodiment incorporating aspects of the present invention. In this embodiment, the locating feature 40 comprises a tongue-in-groove arrangement for supporting the insert 30 in position. As shown, the tongue feature includes a protrusion 40' that is preferably formed on the cast structure, typically the partition ribs 22, but may also be formed on the cast outer wall 12 depending on the shape of the cavity 24 and the insert 30. The protrusion 40' engages in a groove 40" formed in the insert 30. The groove 40" may be formed either on the first or second faces 32, 34, or on the third or fourth faces 36, 38 of the insert 30 depending on whether the protrusion 40' is formed on the outer wall 12 or on the partition ribs 22. The protrusion 40' and the groove 40" may extend along a radial extent of the insert 30. The groove 40" may be dimensioned to receive the protrusion 40' with a desired tolerance, so as to properly fixture the insert 30 in the plane perpendicular to the span of the airfoil 10 (i.e., in the plane of FIG. 5), while allowing some degree of relative movement between the insert 30 and the outer wall 12 on account of differences in thermal and/or mechanical loading during engine operation. Once inserted into the airfoil 10, a locking cap or plate may be used to locate the insert 30 in the span-wise direction. The number of tongue-in-groove features for an individual insert 30 may depend, among other factors, on the shape of the respective cavity 24. For example, if the adjacent ribs 22 defining the cavity 24 are oriented at an angle in relation to each other, it may be sufficient to provide just one tongue-in-groove feature between the insert 30 and the outer wall 12. The tongue-in-groove arrangement may be applicable for metallic inserts or non-metallic (e.g., ceramic) inserts as well as for one-piece inserts or multi-piece inserts for near-wall cooling. The tongue-in-groove feature may also be combined with the previously illustrated flexible locating features for both additional locating support as well cooling flow control.

Figure 6:
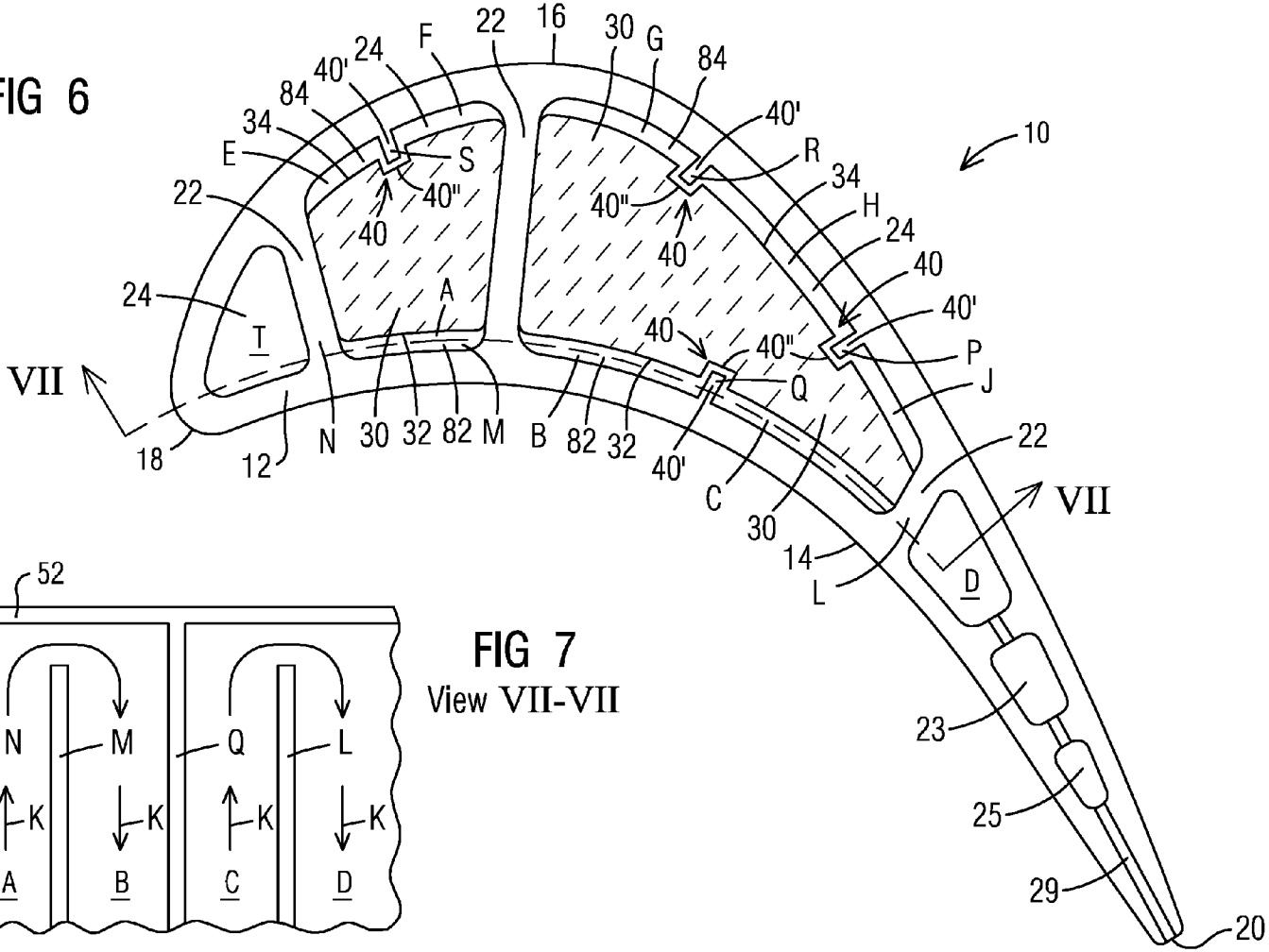
FIG. 6 is a schematic cross-sectional view through a turbine airfoil illustrating a near-wall cooling insert according a third exemplary embodiment.
Figure 7:
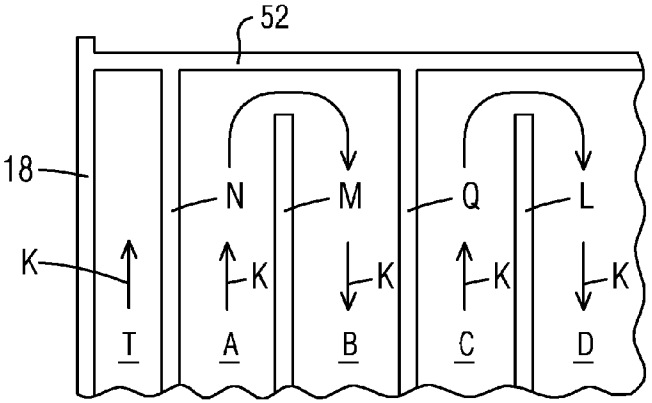
FIG. 7 is a schematic cross-sectional view along the section VII-VII of FIG. 6, illustrating a first example of a serpentine cooling scheme.

Referring to FIGS. 6 and 7, a further embodiment of the present invention is described in which a tongue-in-groove feature is configured to control near-wall coolant flow. In this embodiment, the tongue-in-groove feature includes radially extending protrusions or tongues 40' formed on the outer wall 12 that engage in radial grooves 40" formed on the insert first or second faces 32, 34. For the sake of illustration, the tongues have been individually identified as Q, P, R, S, while the partition ribs 22 have been individually indentified as N, M, L. The arrangement of the tongues Q, P, R, S and the partition ribs N, M, L result in a number of radial flow passes that have been individually identified as A, B, C, D, E, F, G, H, J. Each of the tongues Q, P, R, S serves a dual purpose, namely to locate the respective insert 30 as well as to direct coolant flow along a serpentine flow circuit in the near-wall cooling channels 82, 84. As an example, referring to FIG. 7, the tongue Q divides the near-wall cooling channel 82 into adjacent radial flow passes B and C that conduct coolant K in opposite radial directions. A similar explanation may apply to the tongues P, R, S that are located in the near-wall cooling channels 84. The adjacent radial flow passes may be interconnected at a radial end of the tongues and the partition ribs to form a serpentine cooling circuit. The serpentine scheme may be configured a function of the radial length and/or position of each of the locating tongues in combination with the partition ribs.

An exemplary serpentine scheme is illustrated in FIG. 7. Herein, the flow passes A, C function as "up" passes conducting coolant K radially outward (from root to tip), while the flow pass B functions as a "down" pass conducting coolant K radially inward (from tip to root). Likewise, the flow passes E, G, J function as "up" passes while the flow passes F, H function as "down" passes. The "up" passes C and J feed into the aft located "down" pass D. The flow pass D in turn may feed into trailing edge cooling passages 23 and 25, finally leading to exhaust orifices 29. The exemplary cooling scheme as shown comprises one or more independent aft-flowing serpentine circuits. In other embodiments, one or more forward flowing serpentine circuits may be likewise implemented, that may eventually feed into the leading edge cavity T.

Figure 8:
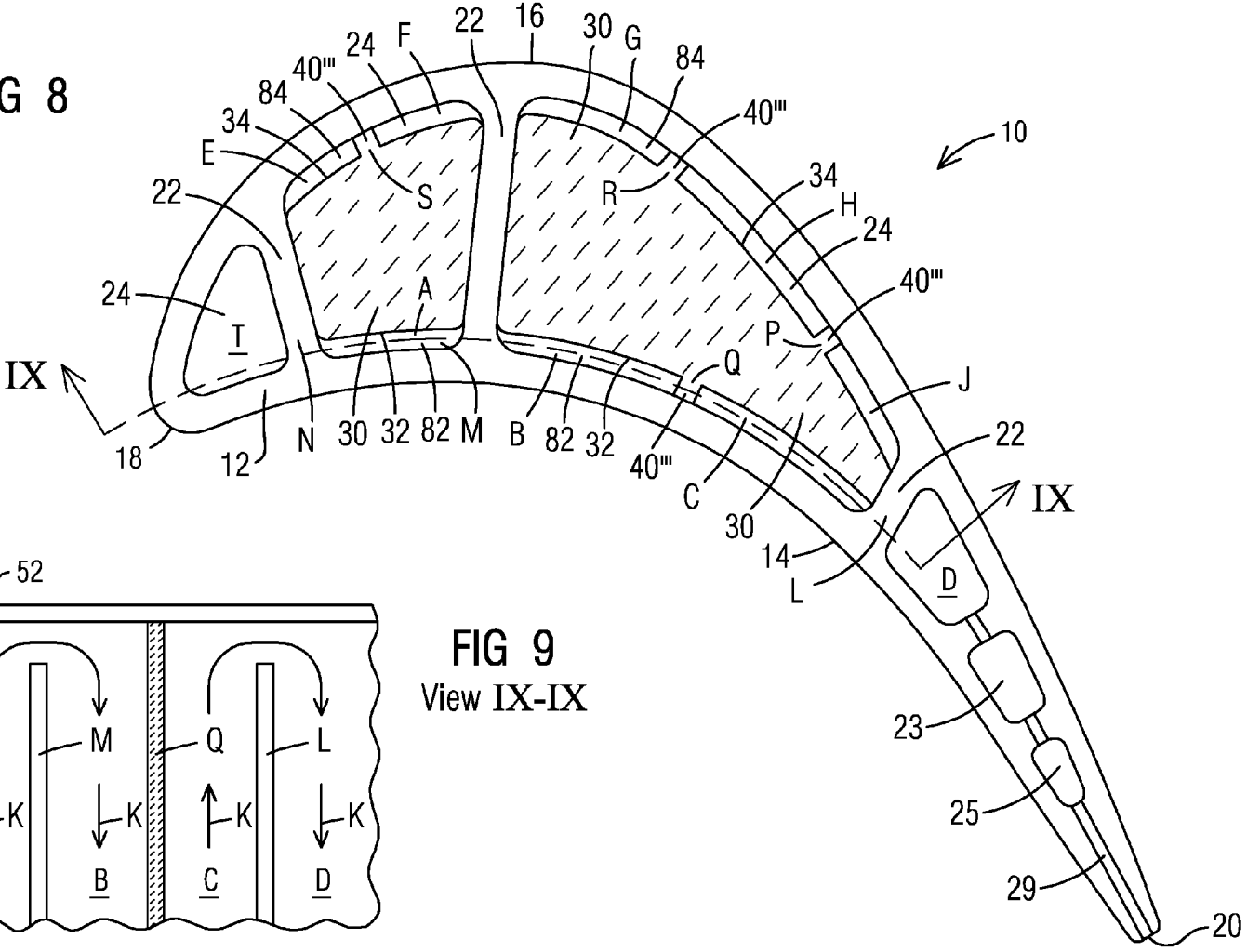
FIG. 8 is a schematic cross-sectional view through a turbine airfoil illustrating a near-wall cooling insert according a fourth exemplary embodiment.
Figure 9:
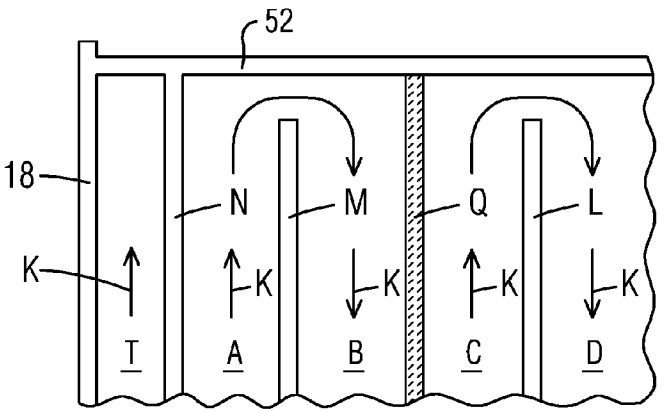
FIG. 9 is a schematic cross-sectional view along the section IX-IX of FIG. 8, illustrating a second example of a serpentine cooling scheme.

In yet another embodiment illustrated in FIGS. 8 and 9, the locating feature may be embodied as a protrusion or a rib 40'" formed on the insert 30 at the first or second face 32, 34. The insert protrusion 40'" extends radially and engages with an inner surface of the outer wall 12 to define recesses on either side that may be configured as radial flow passes. For the sake of clarity, the insert protrusions 40'" have been individually identified as Q, P, R, S, while the partition ribs 22 have been individually indentified as N, M, L. The arrangement of the insert protrusions Q, P, R, S and the partition ribs N, M, L result in a number of radial flow passes that have been individually identified as A, B, C, D, E, F, G, H, J. Each of the insert protrusions Q, P, R, S serves a dual purpose, namely to locate the respective insert 30 as well as to direct coolant flow along a serpentine flow circuit in the near-wall cooling channels 82, 84. As an example, referring to FIG. 9, the insert protrusion Q divides the near-wall cooling channel 82 into adjacent radial flow passes B and C that conduct coolant K in opposite radial directions. A similar explanation may apply to the insert protrusions P, R, S that are located in the near-wall cooling channels 84. The adjacent radial flow passes may be interconnected at a radial end of the insert protrusions and the partition ribs to form a serpentine cooling circuit. The serpentine scheme may be configured a function of the radial length and/or position of each of the locating insert protrusions in combination with the partition ribs. The cooling scheme in this embodiment is similar to that illustrated in FIG. 7 and will hence not be described in any further detail.

The embodiments of the near-wall cooling inserts illustrated in the present disclosure may be assembled into stationary vanes via access holes located at either or both span-wise ends of the vane. Depending on the cooling configuration, it may be favorable to close these access holes with a cover plate, which may, for example, be mechanically attached or welded to the vane after the insert is in place. The illustrated embodiments of the near-wall cooling inserts may also be assembled in fabricated turbine blades, wherein access to the cavity may be provided by a fabrication procedure such as welding the concave or concave skins on to a frame structure. Each of the illustrated embodiments of the near-wall cooling insert could also be retrofitted to an existing airfoil design, for example as a service upgrade. To this end, an aspect of the present invention may be directed to a retrofit kit and to a corresponding retrofit method for improving a turbine airfoil.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

an outer wall delimiting an airfoil interior which comprises internal cooling channels, the outer wall extending span-wise in a radial direction of a turbine engine and formed of a pressure sidewall and a suction sidewall joined at a leading edge and at a trailing edge;

at least one insert positioned in a cavity in the airfoil interior, the insert extending along a radial extent of the turbine airfoil and comprising first and second opposite faces, whereby a first near-wall cooling channel is defined between the first face and the pressure sidewall and a second near-wall cooling channel is defined between the second face and the suction sidewall, the insert being configured to occupy an inactive volume in the airfoil interior so as to displace a radial coolant flow in the cavity toward the first and second near-wall cooling channels; and a locating feature engaging the insert with the outer wall for supporting the insert in position, the locating feature being configured to control flow of the coolant through the first or second near-wall cooling channel, wherein the locating feature is formed integrally with the insert, and wherein the insert is made up of a ceramic material and the locating feature is made up of a metal, the metal being embedded into the ceramic material during a molding process.

2. The turbine airfoil according to claim 1, wherein the locating feature is flexible, being configured to allow the insert and the outer wall to move separately from each other.

3. The turbine airfoil according to claim 2, wherein the locating feature is configured as a compressed spring configured to maintain a pressurized contact with the insert and outer wall.

4. The turbine airfoil according to claim 1, wherein the locating feature extends continuously along a radial extent of the insert, so as to divide the first or second near-wall cooling channel into adjacent flow passes separated by the locating feature, each flow pass conducting coolant in a generally radial direction.

5. The turbine airfoil according to claim 4, wherein the adjacent flow passes conduct coolant in alternating radial directions and are interconnected at a radial end of the locating feature to form a serpentine cooling path in the first or second near-wall cooling channel.

6. The turbine airfoil according to claim 4, wherein the locating feature is curved with a periodic profile along the radial direction.

7. The turbine airfoil according to claim 1, wherein the locating feature comprises multiple discontinuous supports oriented at an angle with respect to the radial direction, defining a coolant flow path having a zigzagged profile along the radial direction in the first or second near-wall cooling channel.

8. The turbine airfoil according to claim 1, wherein the ceramic material of the insert has a different coefficient of thermal expansion than the outer wall of the turbine airfoil.

9. The turbine airfoil according to claim 1, further comprising a plurality of partition ribs connecting the pressure and suction sidewalls, wherein the cavity in which the insert is positioned is formed between a pair of adjacent partition ribs.

10. The turbine airfoil according to claim 1, wherein the cavity in which the insert is positioned is located closer to the leading edge than to the trailing edge.

* * * * *